US008176815B2

(12) United States Patent
Sparks

(10) Patent No.: US 8,176,815 B2
(45) Date of Patent: May 15, 2012

(54) PNEUMATICALLY POWERED ROOF STRIPPING DEVICE

(76) Inventor: Jeff Allen Sparks, Maryville, TN (US)

( * ) Notice: Subject to any disclaimer, the term of this patent is extended or adjusted under 35 U.S.C. 154(b) by 325 days.

(21) Appl. No.: 12/701,256

(22) Filed: Feb. 5, 2010

(65) Prior Publication Data

US 2011/0192256 A1 Aug. 11, 2011

(51) Int. Cl.
*E04D 15/02* (2006.01)

(52) U.S. Cl. ..... 81/45; 30/170; 299/37.1

(58) Field of Classification Search ..... 81/45, 46; 30/169, 170, 272.1; 299/36.1, 37.1; 15/93.1, 15/236.01; 52/748.1, 749.12
See application file for complete search history.

(56) References Cited

U.S. PATENT DOCUMENTS

| | | | | |
|---|---|---|---|---|
| 4,277,104 | A | 7/1981 | Sanchez | |
| 4,691,439 | A | 9/1987 | Marra | |
| 4,709,479 | A | 12/1987 | Lavelette | |
| 4,858,503 | A | 8/1989 | Dike, Jr. | |
| 5,001,946 | A * | 3/1991 | Shirlin et al. | 81/45 |
| 5,076,119 | A | 12/1991 | Wenz | |
| 5,741,047 | A | 4/1998 | Ordonez | |
| 5,800,021 | A * | 9/1998 | Derr | 299/37.1 |
| 5,863,100 | A | 1/1999 | Martin | |
| 5,921,155 | A | 7/1999 | Faller et al. | |
| 6,467,377 | B1 * | 10/2002 | Kersting | 81/45 |
| 7,127,968 | B1 * | 10/2006 | Kriegar | 81/45 |
| 7,313,985 | B2 | 1/2008 | Willis | |
| 7,373,859 | B1 | 5/2008 | Shirlin et al. | |
| 2008/0223178 | A1 | 9/2008 | Creato et al. | |
| 2009/0199508 | A1 | 8/2009 | Fairris | |

* cited by examiner

*Primary Examiner* — David B Thomas
(74) *Attorney, Agent, or Firm* — Luedeka Neely Group, P.C.

(57) ABSTRACT

Embodiments of the invention described herein pertain to a pneumatically powered shingle removing apparatus. The shingle removing apparatus includes a frame having a first end and a second end. A first pneumatic cylinder assembly is mounted adjacent the first end of the frame and a second pneumatic cylinder assembly is mounted adjacent the second end of the frame. The first pneumatic cylinder and the second pneumatic cylinder extend substantially parallel from the frame and each have a chisel extending at least partially from the respective first pneumatic cylinder assembly and the second pneumatic cylinder assembly, the chisels being moveable back and forth from a forward position. A stripping blade is attached to a front end of the chisels of the first pneumatic cylinder assembly and the second pneumatic cylinder assembly. A first air conduit delivers pressurized air to the first pneumatic cylinder assembly and a second air conduit delivers pressurized air to the second pneumatic cylinder assembly. The pressurized air moves the chisels of the first pneumatic cylinder assembly and the second pneumatic cylinder assembly back and forth from the forward position thereby forcing the stripping blade to move in a reciprocating motion for removing shingles from a roof.

16 Claims, 4 Drawing Sheets

PNEUMATICALLY POWERED ROOF STRIPPING DEVICE

FIELD

This invention relates generally to a pneumatically powered shingle stripping device. More specifically, this invention relates to a shingle stripping device having two pneumatically powered air chisels for moving a stripping blade in a reciprocating manner.

BACKGROUND

It is common practice to use hand tools to pry loose and remove shingles from a roof. However, manually removing shingles from the roof is generally a tedious, tiresome, and dangerous task. While power driven roof stripping devices are known in the art, these devices are generally ineffective for a variety of reasons. For example, these devices often have blades that are attached at fixed angles with respect to the device which results in a user having to expend additional energy to adjust and maneuver the blade while prying loose the shingles. Furthermore, many of the prior art devices are not powerful enough to quickly remove shingles or are so bulky and heavy that they are not easily maneuverable on a roof, making them dangerous and difficult to operate.

Accordingly, it is desirable to provide a powered roof stripping device that can rapidly and efficiently remove shingles from a roof. Another object of the invention is to provide a roof stripping device having a stripping blade that may be maneuvered with minimal effort by the user.

SUMMARY

Embodiments of the invention described herein pertain to a pneumatically powered shingle removing apparatus. The apparatus includes a frame having a first end and a second end. A first pneumatic cylinder assembly is mounted adjacent the first end of the frame and a second pneumatic cylinder assembly is mounted adjacent the second end of the frame. The first pneumatic cylinder and the second pneumatic cylinder extend substantially parallel from the frame and each have a chisel extending at least partially from the respective first pneumatic cylinder assembly and the second pneumatic cylinder assembly, the chisels being moveable back and forth from a forward position. A stripping blade is attached to a front end of the chisels. A first air conduit delivers pressurized air to the first pneumatic cylinder assembly and a second air conduit delivers pressurized air to the second pneumatic cylinder assembly, and the pressurized air moves the chisels of the first pneumatic cylinder assembly and the second pneumatic cylinder assembly back and forth from the forward position thereby forcing the stripping blade to move in a reciprocating motion for removing shingles from a roof.

According to some embodiments of the invention, each of the first pneumatic cylinder assembly and the second pneumatic cylinder assembly further includes a diaphragm valve for releasing the pressurized air from one of the first air conduit and the second air conduit into one of the first pneumatic cylinder assembly and the second pneumatic cylinder assembly, a piston disposed adjacent the diaphragm valve for contacting the chisel and pushing the chisel to the forward position when the pressurized air is released from the diaphragm valve, and a spring for returning the chisel from the forward position. In some embodiments, the piston cannot contact the chisel until pressure is placed on the stripping blade.

According to some embodiments, the pressurized air is varyingly distributed between the first pneumatic cylinder assembly and the second pneumatic cylinder assembly by maneuvering the frame towards one of the first end and the second end and applying pressure to the stripping blade. In this embodiment, the chisel of the first pneumatic cylinder assembly moves back and forth from the forward position with a greater stroke and with more power than the chisel of the second pneumatic cylinder assembly when the frame is maneuvered towards the first end of the frame, and the chisel of the second pneumatic cylinder assembly moves back and forth from the forward position with a greater stroke and with more power than the chisel of the first pneumatic cylinder assembly when the frame is maneuvered towards the second end of the frame. A single wheel is attached to a bottom surface of the frame for maneuvering the frame.

In some embodiments of the invention, the stripping blade has a solid cutting edge. The shingle stripping apparatus may also include a handle having a hollow air chamber, the handle for receiving the pressurized air from an air source and the hollow air chamber for delivering the pressurized air to the first and second air conduits. According to some embodiments, the handle includes a plurality of removeable pieces for varying the length of the handle. In yet another embodiment, the frame includes a first cylinder sleeve disposed adjacent the first end for receiving the first pneumatic cylinder assembly and a second cylinder sleeve disposed adjacent the second end for receiving the second pneumatic cylinder sleeve.

BRIEF DESCRIPTION OF DRAWINGS

Further advantages of the invention are apparent by reference to the detailed description in conjunction with the figures.

DETAILED DESCRIPTION

Figure 1:
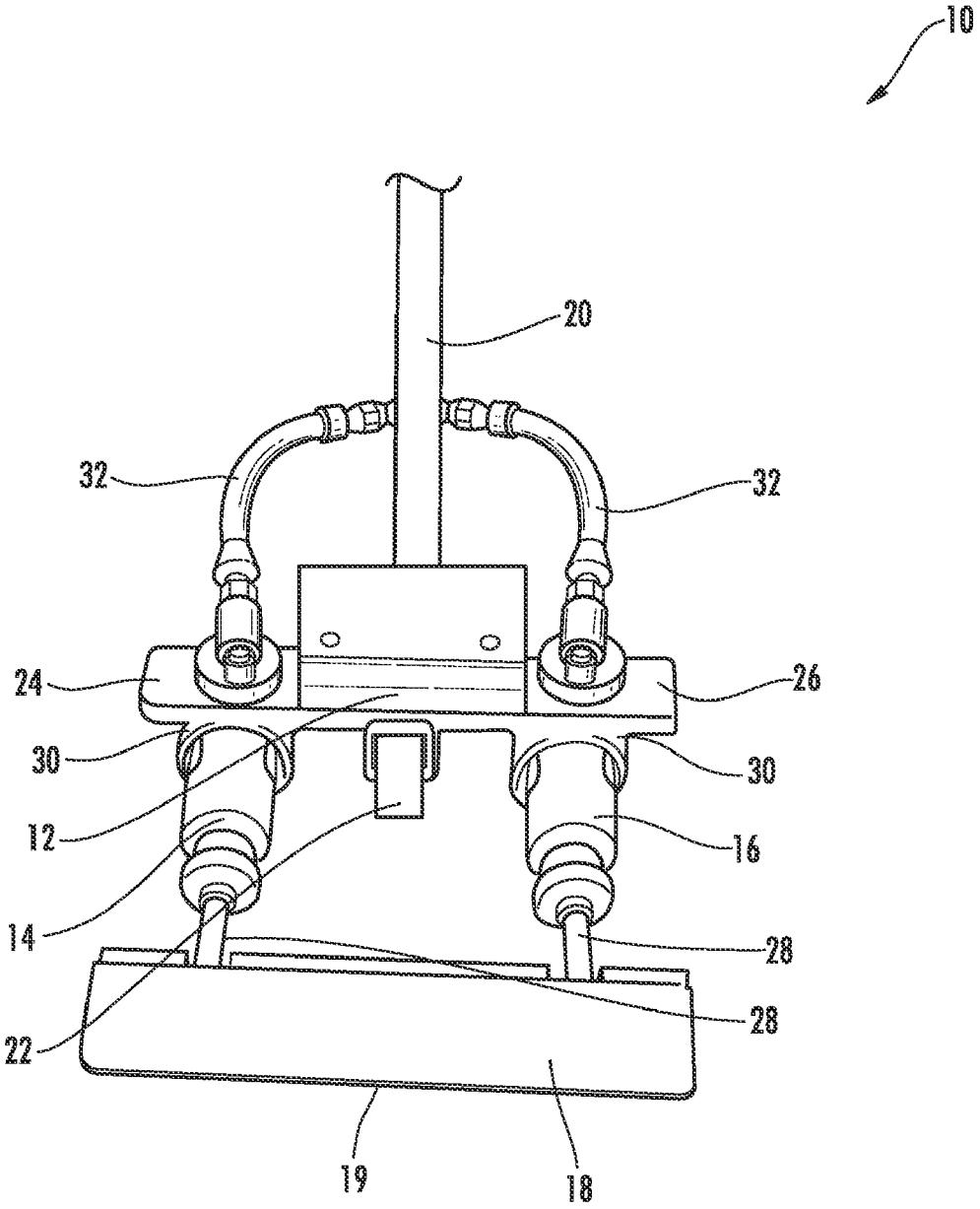
FIG. 1 depicts a front view of a shingle stripping device according to an embodiment of the present invention.
Figure 2:
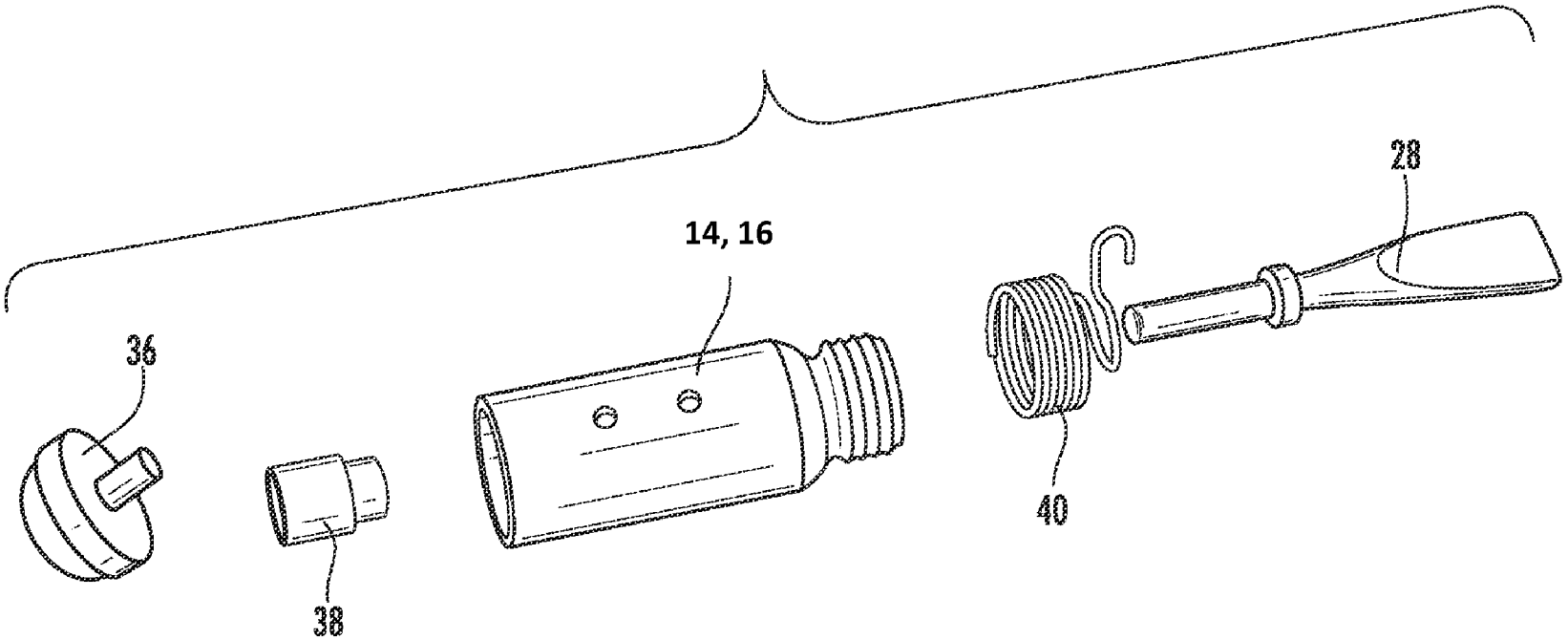
FIG. 2 depicts an internal view of the parts of a pneumatic cylinder assembly according to an embodiment of the present invention.

Referring to FIGS. 1 and 2, a shingle stripping device 10 is shown having a frame 12, a first pneumatic cylinder assembly 14 and a second pneumatic cylinder assembly 16 extending from the frame 12, and a stripping blade 18 attached to the first and second pneumatic cylinder assemblies 14 and 16. The shingle stripping device also includes a handle 20 attached to the rear of the frame 12 and at least one wheel 22 attached to the bottom surface of the frame 12 for maneuvering the stripping device 10. During operation of the shingle stripping device 10, the first and second pneumatic cylinder assemblies 14 and 16 power the device to move the stripping blade 18 in a rapid reciprocating manner to pry loose shingles on a roof.

In preferred embodiments, the stripping blade 18 has a solid cutting edge 19 instead of a blade having multiple cutting teeth like other powered stripping devices. By including a stripping blade 18 having a solid cutting edge 19 instead of multiple cutting teeth, the shingle stripping device 10 includes a stripping blade 18 that does not get hung up or caught on the material being stripped, such as nails, staples, shingles or any other material being removed from the roof.

As shown in FIG. 1, the frame 12 includes a first end 24 and a second end 26. The first pneumatic cylinder assembly 14 is attached adjacent to the first end 24 and the second pneumatic cylinder assembly 16 is attached adjacent the second end 26. The first and second pneumatic cylinder assemblies 14 and 16 extend from their respective ends 24 and 26 of the frame 12 substantially parallel to each other, and each of the first and second pneumatic cylinder assemblies 14 and 16 include chisels 28 extending at least partially from the cylinders. The chisels 28 are operable to move back and forth from their respective cylinder assemblies 14 and 16. In some embodiments of the invention, the first and second ends 24 and 26 of the frame 12 include cylinder sleeves 30 for receiving the first and second pneumatic cylinder assemblies 14 and 16 and securing the cylinders to the frame 12. While the first and second cylinder assemblies 14 and 16 are preferably secured to the cylinder sleeves 30 using a threaded engagement, other securing means are possible such as using bolts and screws.

Figure 4:
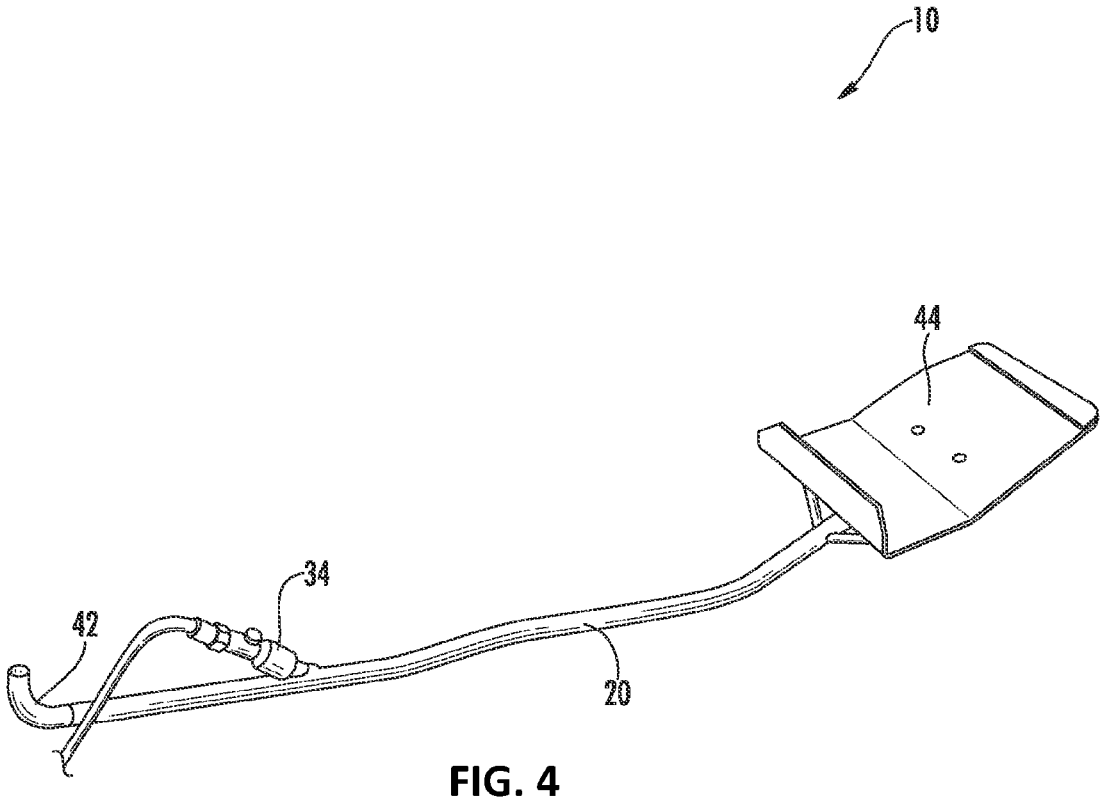
FIG. 4 depicts another view of a shingle stripping device according to an embodiment of the present invention.

In order to power the first and second pneumatic cylinder assemblies 14 and 16 and to move the chisels 28 in a reciprocating manner, air conduits 32 are provided for delivering pressurized air from an air compressor to the first and second pneumatic cylinders 14 and 16. While the pressurized air may be delivered to the shingle stripping device 10 at various locations, in preferred embodiments, the handle 20 has a hollow air chamber and the pressurized air is delivered from the air compressor to the handle 20. In this embodiment, the air conduits 32 are connected to the handle 20, preferably near the bottom of the handle 20, and the pressurized air flows from the handle 20 through the air conduits 32 and into the respective pneumatic cylinders 14 and 16. As shown in FIG. 4, the handle 20 also includes an air valve 34 at the location where the pressurized air enters the handle 20 for regulating the rate of delivery of the pressurized air to the shingle stripping device 10.

Referring to FIG. 2, in some embodiments of the invention, the first and second pneumatic cylinder assemblies 12 and 14 each include a diaphragm valve 36 for releasing the pressurized air from the air conduits 32, a piston 38 disposed adjacent the diaphragm valve 36 for contacting and pushing the chisels 28 to a forward position when the pressurized air is released from the diaphragm valve 38, and a spring 40 or other suitable means known in the art for returning the chisels 28 from the forward position. In preferred embodiments, the pistons 38 can contact the chisels 28 of the first and second pneumatic cylinder assemblies 12 and 14 at speeds of 3,500 blows per minute or greater. Accordingly, the stripping blade 18 of the device 10 is able to rapidly reciprocate back and forth in speeds of about 3,500 blows per minute. Examples of pneumatic cylinder assemblies 12 and 14 that can be used with the single stripping device 10 include Craftsman®'s Impact Hammer Model No. 19897 and Ingersoll Rand®'s Air Hammer Model No. 114GQC.

In some embodiments of the invention, the pneumatic cylinder assemblies 12 and 14 are configured so that they demand more pressurized air and the chisels 28 have a greater stroke when pressure is applied against the stripping blade 18. Furthermore, the greater the pressure that is applied to the stripping blade, the higher the demand is for the pressurized air. According to this embodiment, one example configuration is for the pistons 38 to contact the chisels 28 only when pressure is placed against the stripping blade 18. When pressure is placed against the stripping blade 18, i.e., the stripping blade 18 is positioned against a roof surface or underneath the shingles, the chisels 28 are pushed back to contact the pistons 38 that are being pushed forward by the pressurized air released from the diaphragm valves 36. Thus, the stripping blade 18 is not reciprocating until the blade 16 is pressed against the roof, shingles, or other material underneath the shingles. Furthermore, the more pressure that is placed against the stripping blade 18, the further back the chisels 28 are pushed and the harder the pistons 38 hammer against the chisels 28. In alternate embodiments of the invention, the stripping blade 18 may be constantly reciprocating even if no pressure is applied to the stripping blade 18 by configuring the first and second pneumatic cylinder assemblies 14 and 16 so that the pistons 38 will always contact the chisels 28 after pressurized air is released from the diaphragm valves 36.

Figure 3A:
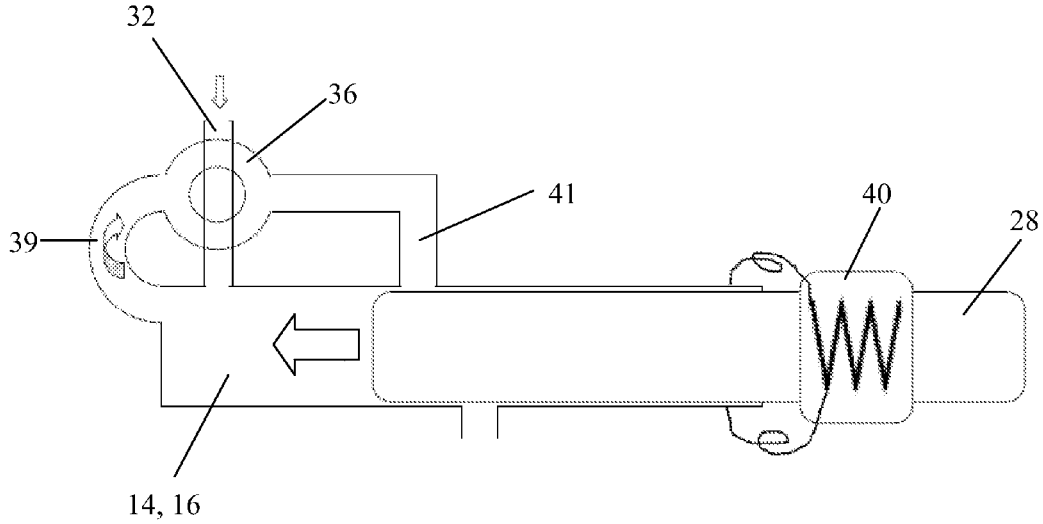
FIG. 3A depicts a schematic diagram of a pneumatic cylinder assembly where the valve is in an open position and the pneumatic cylinder assembly is configured to demand more pressurized air when pressure is applied to the stripping blade according to an embodiment of the present invention.
Figure 3B:
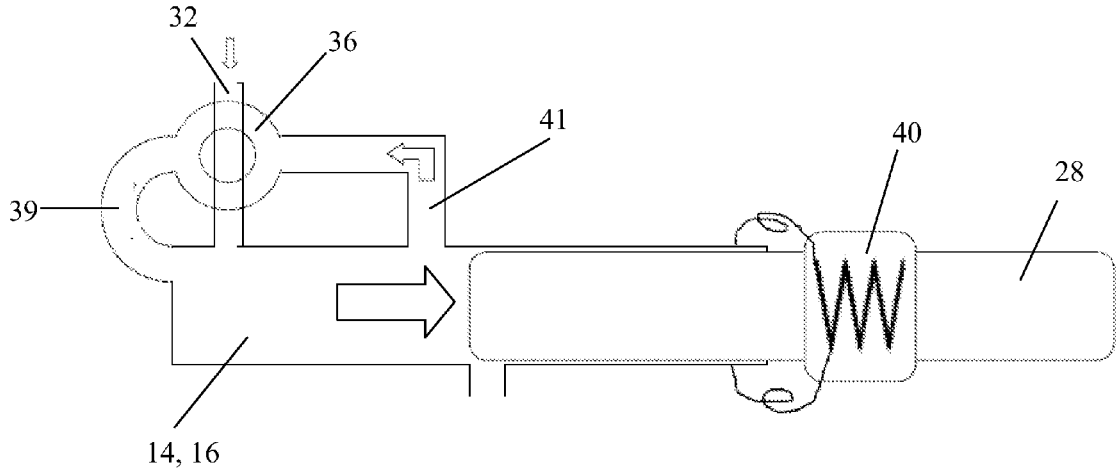
FIG. 3B depicts a schematic diagram of a pneumatic cylinder assembly where the valve is in a closed position and the pneumatic cylinder assembly is configured to demand more pressurized air when pressure is applied to the stripping blade according to an embodiment of the present invention.

Referring to the schematic diagrams of FIGS. 3A and 3B, another possible configuration of the pneumatic cylinder assemblies 12 and 14 is shown where they are configured to demand more pressurized air when pressure is applied to the stripping blade 18. In this configuration, when pressure is applied to the stripping blade 18, the chisel 28 is pushed back so that the pressurized air in the pneumatic cylinder assembly 12 and 14 is pushed through the first air port 39 as shown in FIG. 3A. The air moving through the first air port 39 then opens the valve 36 so that the pressurized air is delivered through the air conduit 32 into the pneumatic cylinder assembly 12 and 14. The pressurized air being delivered through the air conduit 32 and open valve 36 results in the chisel 28 being pushed to the forward position. This opens up the second air port 41 for the pressurized air to travel through and close the valve 36 as shown in FIG. 3B. This cycle is repeated so that the chisel 28 moves back and forth from the forward position in a rapid reciprocating manner. A spring 40 may also be used to push the chisel 28 back in addition to the pressure being applied to the stripping blade.

In another aspect of the invention, having multiple pneumatic cylinder assemblies being connected to an external air source using separate air conduits allows a user of the shingle stripping device 10 to distribute increased power to separate portions of the stripping blade 18. For example, in the embodiments of the invention described above where the pneumatic cylinder assemblies are configured so that they demand more pressurized air and the chisels 28 have a greater stroke when pressure is applied against the stripping blade 18, the user of the shingle stripping device 10 may distribute more power to the portion of the blade 18 that is attached to the first pneumatic cylinder assembly 14 by leaning and/or maneuvering the shingle stripping device 10 towards the direction of the first end 24 of the frame 12 so that more pressure is applied to that portion of the blade 18. Thus, more power is transferred to the first pneumatic cylinder assembly 14, resulting in its chisel 28 moving back and forth from the forward position with more power and/or a longer stroke than the chisel 28 of the second pneumatic cylinder assembly 16. Alternatively, the user may distribute more power to the portion of the blade that is attached to the second pneumatic cylinder assembly 16 by leaning and/or maneuvering the shingle stripping device 10 towards the direction of the second end 26 of the frame 12 so that more pressure is applied to that portion of the blade 18. When the shingle stripping device 10 is balanced evenly between the first end 24 and the second end 26, the first and second pneumatic cylinder assemblies 14 and 16 will demand generally the same proportionate amount of pressurized air. Thus, the chisels 28 of the first and second pneumatic cylinder assemblies will be substantially synchronized in their movement back and forth from the forward position when the device 10 is in a balanced position.

As described above, it is important for the shingle stripping device 10 to be easily maneuverable for various reasons, including the ability to easily maneuver the device 10 towards the first end 24 or second end 26 of the frame 12 to distribute power to varying portions of the stripping blade 16. Thus, in preferred embodiments, the shingle stripping device 10 includes only one wheel 22 disposed adjacent the center of the bottom surface of the frame 12 for allowing the user to maneuver the device by simply applying pressure to one side of the wheel 22.

In other aspects of the invention, the handle 20 may be separated into a plurality of pieces for varying the length of the handle 20. The pieces may be joined together by a quick coupling mechanism so that the handle may be quickly and securely attached and reattached. Also attached to the handle 20, as shown in FIG. 4, is a gripper 42 for allowing the user to hold onto the handle 20 and easily maneuver the shingle stripping device 10. The gripper 42 may be disposed anywhere along the handle 20 but is preferably disposed on the end of the handle 20 furthers from the frame. A shingle deflector 44 may be attached to the top surface of the frame 12 to deflect and/or catch removed shingles as they are removed from the roof. The shingle deflector 44 preferably also covers and protects the first and second pneumatic cylinder assemblies 14 and 16.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A shingle removing apparatus comprising:

a frame having a first end and a second end;

a first pneumatic cylinder assembly mounted adjacent the first end of the frame and a second pneumatic cylinder assembly mounted adjacent the second end of the frame, the first pneumatic cylinder and the second pneumatic cylinder extending substantially parallel from the frame and each having a chisel extending at least partially from the first pneumatic cylinder assembly and the second pneumatic cylinder assembly, the chisels being moveable back and forth from a forward position;

a stripping blade attached to a front end of the chisels of the first pneumatic cylinder assembly and the second pneumatic cylinder assembly; and a first air conduit for delivering pressurized air to the first pneumatic cylinder assembly and a second air conduit for delivering pressurized air to the second pneumatic cylinder assembly, the pressurized air for moving the chisels of the first pneumatic cylinder assembly and the second pneumatic cylinder assembly back and forth from the forward position thereby forcing the stripping blade to move in a reciprocating motion for removing shingles.

2. The shingle removing apparatus according to claim 1 wherein each of the first pneumatic cylinder assembly and the second pneumatic cylinder assembly further comprises:

a diaphragm valve for releasing the pressurized air from one of the first air conduit and the second air conduit into one of the first pneumatic cylinder assembly and the second pneumatic cylinder assembly;

a piston disposed adjacent the diaphragm valve for contacting the chisel and pushing the chisel to the forward position when the pressurized air is released from the diaphragm valve; and a spring for returning the chisel from the forward position.

3. The shingle removing apparatus of claim 2 wherein the piston of the first pneumatic cylinder assembly and second pneumatic cylinder assembly is able to contact the chisel when pressure is placed on the stripping blade.

4. The shingle removing apparatus according to claim 1 wherein the first pneumatic cylinder assembly and second pneumatic cylinder assembly are configured so that pressurized air is varyingly distributed between the first pneumatic cylinder assembly and the second pneumatic cylinder assembly by maneuvering the frame towards one of the first end and the second end and applying pressure to the stripping blade.

5. The shingle removing apparatus according to claim 4 wherein the chisel of the first pneumatic cylinder assembly moves back and forth from the forward with a greater stroke and with more power than the chisel of the second pneumatic cylinder assembly when the frame is maneuvered towards the first end of the frame, and the chisel of the second pneumatic cylinder assembly moves back and forth from the forward position with a greater stroke and with more power than the chisel of the first pneumatic cylinder assembly when the frame is maneuvered towards the second end of the frame.

6. The shingle removing apparatus according to claim 4 further comprising a single wheel attached to a bottom surface of the frame for maneuvering the frame.

7. The shingle removing apparatus according to claim 1 wherein the stripping blade has a solid cutting edge.

8. The shingle removing apparatus according to claim 1 further comprising a handle attached to the frame having a hollow air chamber, the handle for receiving the pressurized air from an air source and the hollow air chamber for delivering the pressurized air to the first and second air conduits.

9. The shingle removing apparatus according to claim 8 wherein the handle includes a plurality of removable pieces for varying the length of the handle.

10. The shingle removing apparatus according to claim 1 wherein the frame includes a first cylinder sleeve disposed adjacent the first end for receiving the first pneumatic cylinder assembly and a second cylinder sleeve disposed adjacent the second end for receiving the second pneumatic cylinder assembly.

11. A shingle removing apparatus comprising:

a frame having a first end and a second end;

a first pneumatic cylinder assembly mounted adjacent the first end of the frame and a second pneumatic cylinder assembly mounted adjacent the second end of the frame, the first pneumatic cylinder and the second pneumatic cylinder extending substantially parallel from the frame and each having a chisel extending at least partially from the respective first pneumatic cylinder assembly and the second pneumatic cylinder assembly, the chisels being moveable back and forth from a forward position;

a stripping blade attached to a front end of the chisels of the first pneumatic cylinder assembly and the second pneumatic cylinder assembly;

a first air conduit for delivering pressurized air to the first pneumatic cylinder assembly and a second air conduit for delivering pressurized air to the second pneumatic cylinder assembly, the pressurized air for moving the chisels of the first pneumatic cylinder assembly and the second pneumatic cylinder assembly back and forth from the forward position thereby forcing the stripping blade to move in a reciprocating motion for removing shingles from a roof; and a single wheel attached to a bottom surface of the frame for maneuvering the frame, wherein the apparatus is configured so that pressurized air is varyingly distributed between the first pneumatic cylinder assembly and the second pneumatic cylinder assembly by maneuvering the frame towards one of the first end and the second end and applying pressure to the stripping blade.

12. The shingle removing apparatus according to claim 11 wherein each of the first pneumatic cylinder assembly and the second pneumatic cylinder assembly further comprises:

a diaphragm valve for releasing the pressurized air from one of the first air conduit and the second air conduit into one of the first pneumatic cylinder assembly and the second pneumatic cylinder assembly;

a piston disposed adjacent the diaphragm valve for contacting the chisel and pushing the chisel to the forward position when the pressurized air is released from the diaphragm valve; and a spring for returning the chisel from the forward position.

13. The shingle removing apparatus according to claim 11 further comprising a handle attached to the frame having a hollow air chamber, the handle for receiving the pressurized air from an air source and the hollow air chamber for delivering the pressurized air to the first and second air conduits.

14. The shingle removing apparatus according to claim 11 wherein the chisel of the first pneumatic cylinder assembly moves back and forth from the forward position with more power than the chisel of the second pneumatic cylinder assembly when the frame is maneuvered towards the first end of the frame, and the chisel of the second pneumatic cylinder assembly moves back and forth from the forward position with more power than the chisel of the first pneumatic cylinder assembly when the frame is maneuvered towards the second end of the frame.

15. The shingle removing apparatus according to claim 11 wherein the chisel of the first pneumatic cylinder assembly moves back and forth from the forward position with a greater stroke than the chisel of the second pneumatic cylinder assembly when the frame is maneuvered towards the first end of the frame, and the chisel of the second pneumatic cylinder assembly back and forth from the forward position with a greater stroke than the chisel of the first pneumatic cylinder assembly when the frame is maneuvered towards the second end of the frame.

16. The shingle removing apparatus according to claim 11 wherein the chisel of the first pneumatic cylinder assembly moves back and forth from the forward position with a greater stroke and with more power than the chisel of the second pneumatic cylinder assembly when the frame is maneuvered towards the first end of the frame, and the chisel of the second pneumatic cylinder assembly moves back and forth from the forward position with a greater stroke and with more power than the chisel of the first pneumatic cylinder assembly when the frame is maneuvered towards the second end of the frame.

* * * * *